US009927185B1

(12) United States Patent
Boyd, IV

(10) Patent No.: US 9,927,185 B1
(45) Date of Patent: Mar. 27, 2018

(54) SYSTEM FOR COOLING DOWN BOILING VESSELS

(71) Applicant: Robert Boyd, IV, Mandeville, LA (US)

(72) Inventor: Robert Boyd, IV, Mandeville, LA (US)

( * ) Notice: Subject to any disclaimer, the term of this patent is extended or adjusted under 35 U.S.C. 154(b) by 140 days.

(21) Appl. No.: 14/738,651

(22) Filed: Jun. 12, 2015

(51) Int. Cl.
*A47J 27/00* (2006.01)
*F28F 1/00* (2006.01)

(52) U.S. Cl.
CPC ..... *F28F 1/003* (2013.01)

(58) Field of Classification Search
CPC . F28F 1/003; A62C 3/00; A62C 3/002; A62C 3/004; A62C 3/006; A62C 3/008; A62C 3/0214; A62C 3/0264; A62C 3/065
USPC ..... 126/380.1; 65/101, 115, 169; 165/169, 165/101, 115
See application file for complete search history.

(56) References Cited

U.S. PATENT DOCUMENTS 1,817,232 A * 8/1931 Buhrig ..... C12C 11/006 165/101
2,890,937 A * 6/1959 Bresee ..... C01C 1/022 422/148
4,875,344 A 10/1989 Zittel
6,029,463 A 2/2000 Stenvinkel

FOREIGN PATENT DOCUMENTS

| | | |
|---|---|---|
| JP | H10127487 | 5/1998 |
| JP | 2005110937 | 4/2005 |
| JP | 2012109495 | 6/2012 |
| WO | WO2014036934 | 3/2014 |

OTHER PUBLICATIONS

How to Cool Wort-Chill Beer Fast with Cold Water or a Chiller (http://www.homebrewing.org/HowtoCoolWort_ep_371.html (last visited Aug. 24, 2015)).
Todd's Boiled Crawfish-Cooking Louisiana (http://www.cookinglouisiana.com/Cooking/Recipes/Seafood/Todds%20Boiled%20Crawfish.htm (last visited Aug. 24, 2015)).

* cited by examiner

*Primary Examiner* — Vivek Shirsat
(74) *Attorney, Agent, or Firm* — Garvey, Smith & Nehrbass, Patent Attorneys, L.L.C.; Gregory C. Smith; Julia M. FitzPatrick

(57) ABSTRACT

A system for cooling down a boiling vessel, such as a pot, including at least a first length of tubing encircling an outer wall of the pipe, and having a fluid flow bore through its length, supported by opposing handles of the pot; a connector for engaging an end of a water line to the first length of tubing; a source of water introduced into the first length of tubing, under pressure, so that the water travels through the entire first length of tubing; a plurality of flow openings spaced along the walls of the first length of tubing, so that water is sprayed from the openings against the outer wall of the pot from both the first length of tubing, to cool the pot along its entire outer wall. There may be further provided additional lengths of tubing spraying water against the pot wall and a collection pan positioned below the pot to collect water flowing off of the wall of the pot, so that the water can flow from the pan into a hose to direct the water to a point away from the boiling pot.

10 Claims, 3 Drawing Sheets

SYSTEM FOR COOLING DOWN BOILING VESSELS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Field of the Invention

The present invention relates to cooling of vessels used in boiling. More particularly, the present invention relates to a system for cooling down a seafood boiling pot, which provides an exterior network of tubing into which water is introduced and is allowed to spray from a plurality of openings in the wall of the tubing against the outer pot wall in a sufficient amount to cool the pot down to a desired temperature.

General Background

In the art of cooking seafood, such as crabs, crayfish, shrimp and other crustaceans, one of the most desired manners in which this type of food is prepared is to boil the crustaceans in a large pot in well-seasoned water. This is usually done outdoors, preferably during the Spring, and in particular in the South, where crustaceans are very abundant. Usually, a large 40 gallon pot is placed on a stand which has a natural gas burner, and once the pot of seasoned water is boiling, the crustaceans are dumped into the water and allowed to boil and absorb the seasoning so that the result is very delicious boiled crustaceans, such as crabs, crayfish, and shrimp.

As part of this ritual, it is important that the boiling water return to a cooler state after the boiling is complete. In the present state of the art, the most common way of cooling the hot water is to dump a large quantity of ice into the pot. This method does cool the very hot water, particularly at the upper portion of the pot, but less so at the lower portion of the pot. This is a shortcoming, since the crustaceans, for example, crayfish, at the bottom of the pot are not being cooled and would continue to "cook" in the hot water. The most common result is that these crayfish may become very difficult to peel, which is an undesirable result. In addition, the water in the pot contains a large quantity of spices which give the food boiled seafood flavor, and may be used to repeat two or three boils. However, when ice is added to the boil, to cool the contents down, the ice melts and dilutes the boil contents, and subsequent boils have less taste and flavor.

Therefore, there is a need in the art for a method to cool crustaceans in a post boiling pot so that all of the crustaceans are cooled quickly, efficiently and evenly throughout the space within the pot, without adding additional water or ice into the boiling pot.

The following possibly relevant patents are incorporated herein by reference.

TABLE

| Pat. No. | Title | Issue Date |
|---|---|---|
| 4,875,344 | CHILLER | Oct. 24, 1989 |
| 6,029,463 | METHOD AND APPARATUS FOR COOLING OR CONDENSING MEDIUMS | Feb. 29, 2000 |

SUMMARY OF THE PRESENT INVENTION

The preferred embodiment of the present invention provides a system for cooling down a boiling vessel, such as a pot, which includes a first length of tubing encircling an outer wall of the pipe, and having a fluid flow bore through its length, supported by opposing handles of the pot; a second length of tubing encircling the outer wall of the pipe a distance below the first length of tubing, having a fluid flow bore through its length; a plurality of lengths of tubing connecting the first length of tubing to the second length of tubing; a connector for engaging an end of a water line to the second length of tubing; a source of water introduced into the second length of tubing, under pressure, so that the water travels through the second length of tubing, through the plurality of lengths of tubing connecting to the first length of tubing, and water travels to the first length of tubing; a plurality of flow openings spaced along the walls of the first and second length of tubing, so that water is sprayed from the openings against the outer wall of the pot from both the first and second length of tubing, to cool the pot along its entire outer wall; and a collection pan positioned below the pot to collect water flowing off of the wall of the pot, so that the water can flow from the pan into a hose to direct the water to a point away from the boiling pot.

Therefore, in embodiments of the present invention, there is provided a system for cooling down a seafood boiling pot, which provides an exterior network of tubing into which water is introduced and is allowed to spray from a plurality of openings in the wall of the tubing against the outer pot wall in a sufficient amount to cool the pot down to a desired temperature.

In embodiments of the present invention there is provided a system for cooling down a seafood boiling pot after boiling is complete without having to introduce a cold fluid or ice into the pot.

In embodiments of the present invention, there is provided a system for cooling down a boiling pot by allowing a flow of cooler water against the outer wall of the pot until the contents of the pot are sufficiently cool.

Embodiments of the system and method of the present invention may be used when boiling various food items, including boiled seafood or crustaceans.

Embodiments of the present invention comprise a system for cooling down a boiling vessel, such as a pot, comprising:

a) at least a first length of tubing defining an upper ring encircling and supported by an outer wall of the pot;

b) a continuous fluid flow bore through the tubing;

c) a connector for engaging an end of a water line to the first length of tubing;

d) a source of water introduced into the first length of tubing, under pressure, so that the water travels through the entire first length of tubing;

e) a plurality of flow openings spaced along the walls of the first length of tubing, so that water is sprayed from the openings against the outer wall of the pot from both the first length of tubing, to cool the pot along its entire outer wall.

Embodiments of the system of the present invention comprise a second length of tubing defining a lower ring having a fluid flow bore through its length and engaged below the first length of tubing, through a plurality of connector tubing, so that water flowing through the first length of tubing flows into the second length of tubing and is sprayed through a plurality of flow openings against the wall of the pot.

In embodiments of the present invention there is further provided one or more lengths of tubing connecting the first and second lengths of tubing to define a continuous channel for the water to flow among the upper and lower rings.

In embodiments of the present invention there is further provided a collection pan positioned below the pot to collect water flowing off of the wall of the pot, so that the water can flow from the pan into a hose to direct the water to a point away from the boiling pot.

In embodiments of the present invention the first length of tubing is supported by the opposing handles of the pot as it is positioned around the wall of the pot.

Embodiments of the present invention comprise a system for cooling down a boiling vessel, such as a pot, comprising:

a) a first length of tubing defining an upper ring encircling an outer wall of the pipe, and having a fluid flow bore through its length, first length of tubing supported by opposing handles of the pot;

b) at least a second length of tubing defining a lower ring encircling the outer wall of the pipe a distance below the first length of tubing, having a fluid flow bore through its length;

c) a plurality of lengths of tubing connecting the first length of tubing to the second length of tubing;

d) a connector for engaging an end of a water line to the second length of tubing;

e) a source of water introduced into the second length of tubing, under pressure, so that the water travels through the second length of tubing, through the plurality of lengths of tubing connecting to the first length of tubing, and water travels to the first length of tubing; and f) a plurality of flow openings spaced along the walls of the first and second length of tubing, so that water is sprayed from the openings against the outer wall of the pot from both the first and second length of tubing, to cool the pot along its entire outer wall.

In embodiments of the present invention, there is further provided a collection pan positioned below the pot to collect water flowing off of the wall of the pot, so that the water can flow from the pan into a hose to direct the water to a point away from the boiling pot.

In embodiments of the present invention, there may be provided two or more rings surrounding the pot wall, all of the rings connected together as a single system to deliver water against the outer wall of the pot to cool the contents of the pot.

Additional embodiments of the present invention comprise a system for cooling down a boiling vessel, such as a pot, comprising:

a) an upper length of tubing encircling an outer wall of the pipe, and having a fluid flow bore through its length, supported by opposing handles of the pot;

b) at least a lower length of tubing encircling the outer wall of the pipe a distance below the upper length of tubing, having a fluid flow bore through its length;

c) a plurality of lengths of tubing connecting the upper length of tubing to the lower length of tubing;

d) a connector for engaging an end of a water line to the lower length of tubing;

e) a source of water introduced into the lower length of tubing, under pressure, so that the water travels through the lower length of tubing, through the plurality of lengths of tubing connecting to the upper length of tubing, and water travels to the upper length of tubing;

f) a plurality of flow openings spaced along the walls of the upper and lower lengths of tubing, so that water is sprayed from the openings against the outer wall of the pot from both the upper and lower lengths of tubing, to cool the pot along its entire outer wall; and g) a collection pan positioned below the pot to collect water flowing off of the wall of the pot, so that the water can flow from the pan into a hose to direct the water to a point away from the boiling pot.

In embodiments of the present invention, a first length of tubing is supported by opposing handles of the pot as it is positioned around the wall of the pot.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
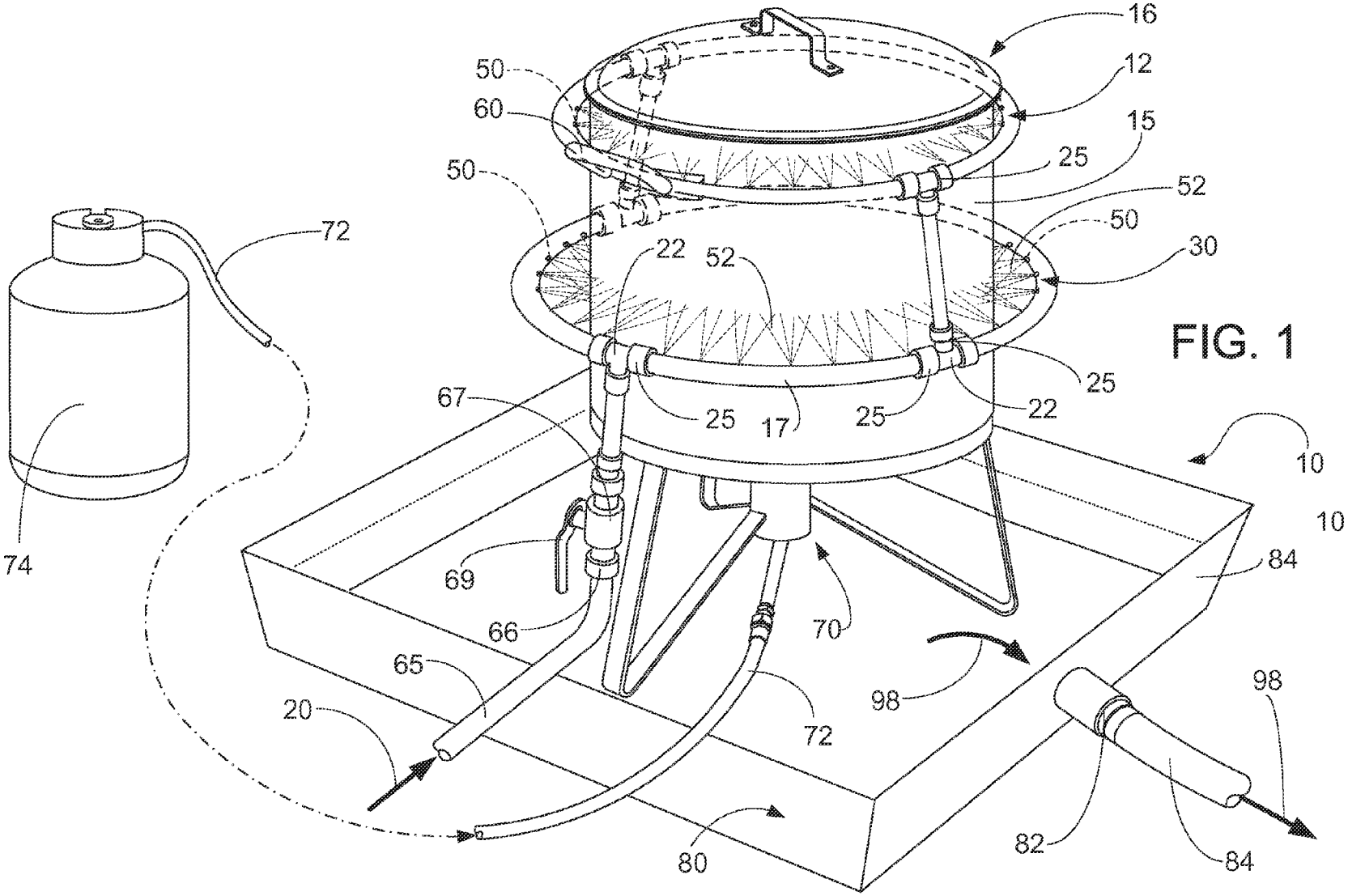
FIG. 1 illustrates an overall view of the preferred embodiment of the present invention positioned around a large boiling pot supported on a burner assembly.

FIGS. 1 through 8 illustrate the preferred embodiment of the boiling pot cooling system of the present invention, also referred to as the system 10 of the present invention. First, as illustrated in overall view in FIG. 1, the system 10 comprises at least an upper first continuous ring 12 of tubing 14 surrounding and spaced apart from the outer wall 15 of pot 16. Tubing 14 would be a flexible tubing having a fluid flow bore 18 therethrough for allowing a fluid, preferably water 20, to flow through the flow bore 18, for reasons to be described further. The tubing 14 would be of the type which is flexible, yet has the ability to withstand heat emanating from the heated pot 16, following the cooking process. A typical type of preferred tubing would be of the type manufactured by Uponor, Inc., sold under the trademark ProPEX, although other types of tubing may be used.

As further illustrated in the Figures, there would be a second lower ring 30 which would be positioned along the lower wall portion 17 of the pot 16, and would be of a slightly larger diameter than the upper ring for reasons to be explained further. As further illustrated, the lower ring 30 would be interconnected to the upper ring 12 with a plurality of tubing sections 40 of tubing 12. To accomplish this, the upper ring 12 of tubing 14 would include at least one or more junctions 22 having a pair of nipples 25 which would allow the end sections of tubing 14 to engage and define the continuous upper ring 12. Each junction 22 would also have a vertically depending nipple 25 so that a section of tubing 40 could be joined to the ring 12 on its upper end 42. Likewise, the lower ring 30 would be provided with a similar type of junctions 22, to join the sections of lower ring 30 to define the continuous lower ring 30. Each junction 22 would have the vertically depending nipple 25 extending upward from ring 30 so that the lower end 43 of sections 40 would join the lower ring 30. As illustrated, in the preferred embodiment there would be provided three junctions 22 along each upper and lower rings 12, 30 respectively, that would allow three ring sections 40 to attach between the rings to define the cooling rings surrounding the hot pot 16. If desired, there may be more or less than the three junctions 22 along the lengths of the tubing 12 and 30.

Figure 2:
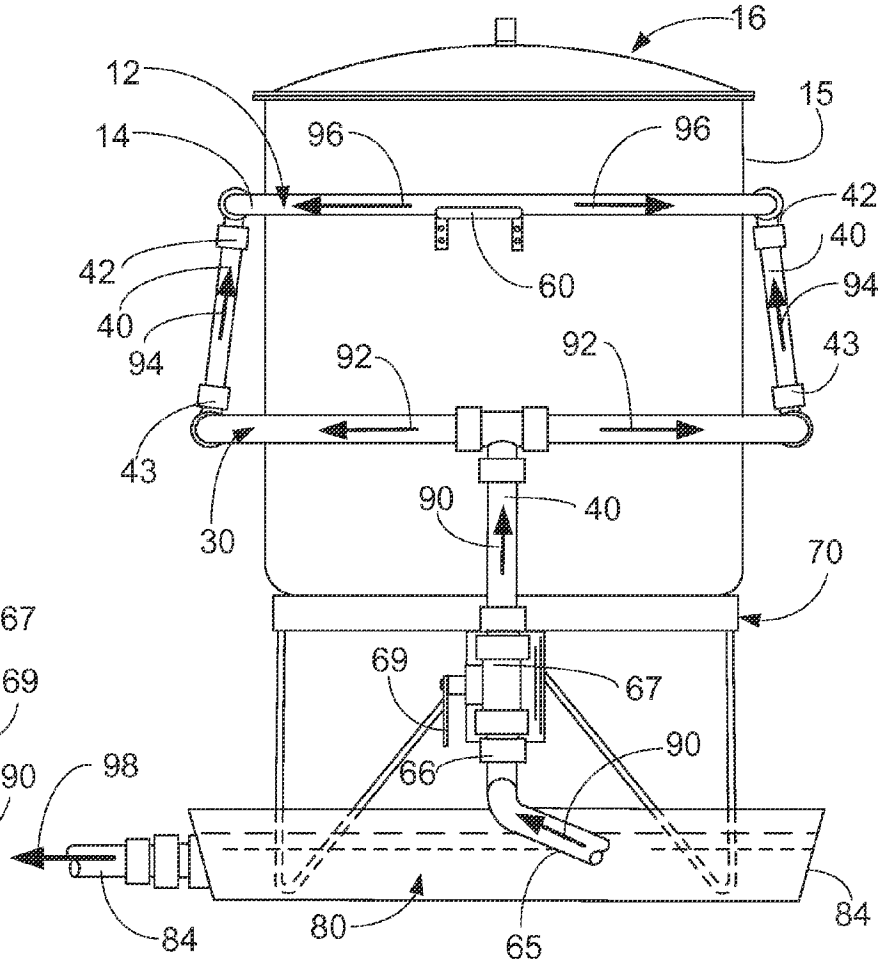
FIGS. 2 and 3 illustrate side views of the preferred embodiment of the present invention as illustrated in FIG. 1.
Figure 3:
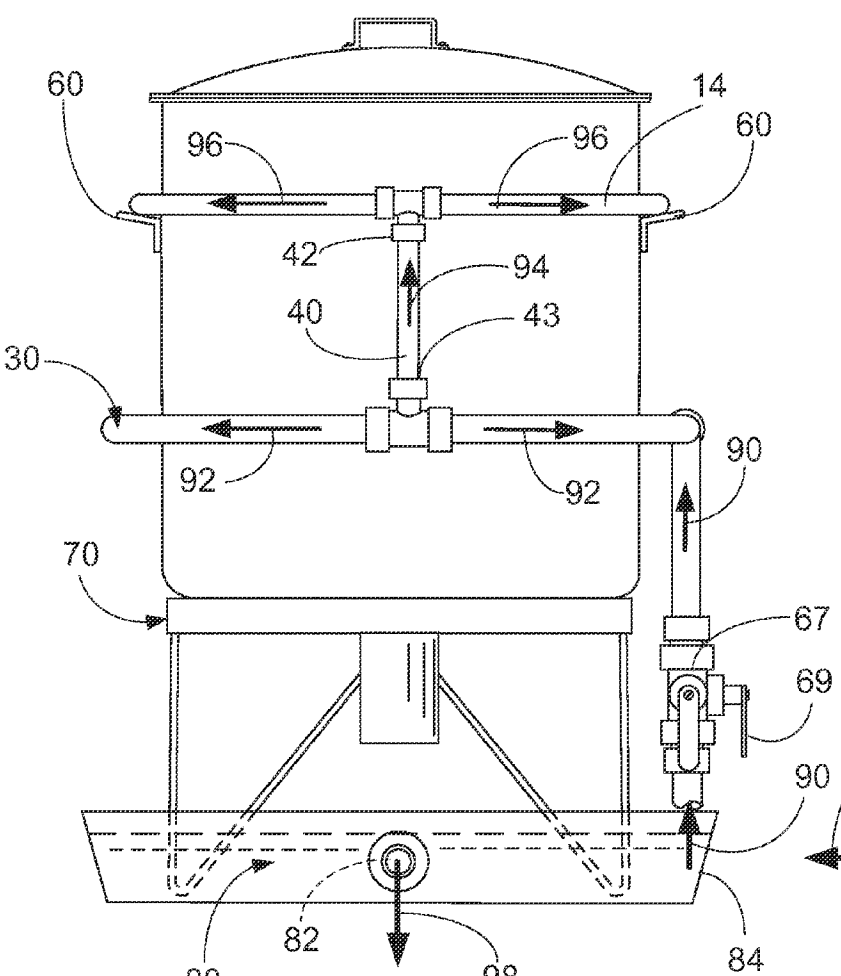
Figure 5:
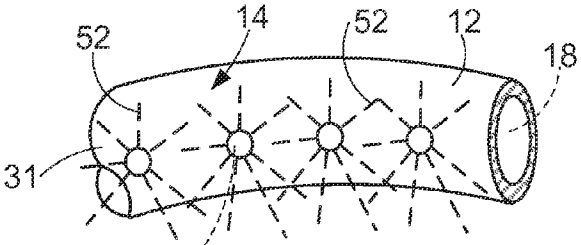
FIG. 5 illustrates another view of the tubing in FIG. 4 further illustrating fluid, such as water, spraying from orifices in the wall of the tubing.
Figure 6:
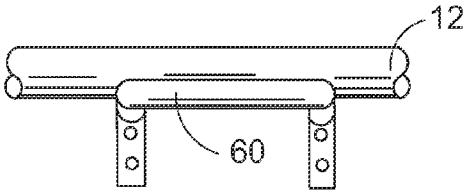
FIGS. 6 through 8 illustrate multiple views of the upper ring of tubing supported by the opposing handles of the large boiling pot in the present invention.
Figure 8:
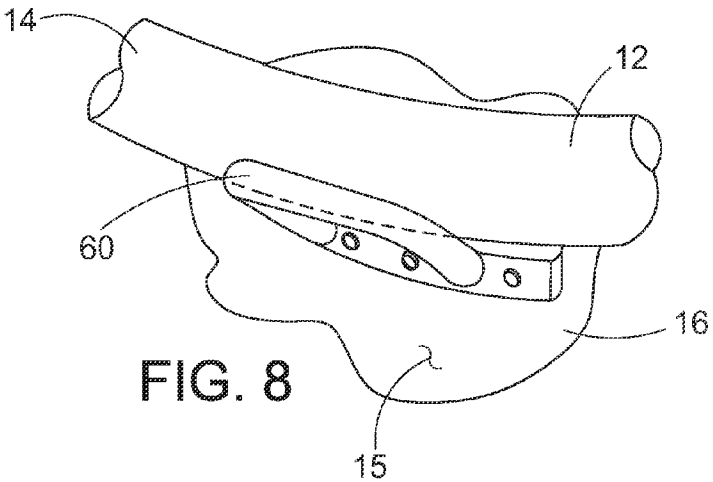
Figure 4:
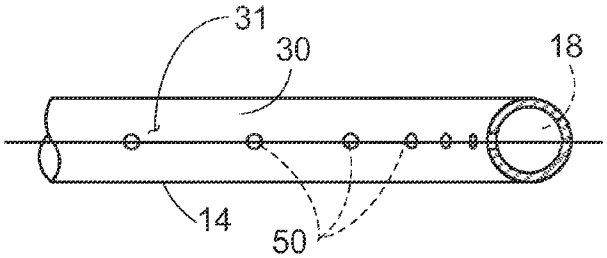
FIG. 4 illustrates a partial view of a section of the tubing which comprises the cooling assembly of the present invention.
Figure 7:
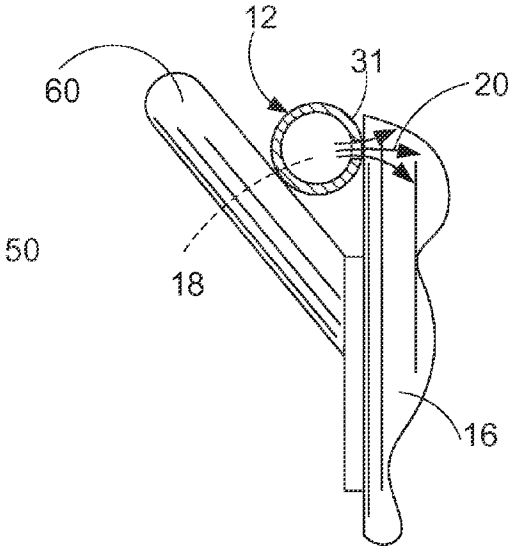

Before reference is made to FIGS. 2 and 3, turning to FIGS. 4 and 5 there is illustrated a portion of each upper and lower rings 12, 30, where there is seen a plurality of spaced apart orifices 50 along the interior wall 31 of each ring 12, and 30, which would allow water flowing under pressure in the rings to emit a spray 52 of water, as seen in FIG. 5, to be sprayed against the outer wall 15 of pot 16, as illustrated in FIG. 1.

Turning again to FIG. 1, the upper ring 12 and lower ring 30, which are joined together via a plurality of ring sections 40 are seen positioned around the wall of the pot 16, with the upper ring 12 supported by the opposing handles 60 of a typical boiling pot 16. As was stated earlier, in the preferred embodiment the lower ring 30 would be of a greater diameter than upper ring 12 so that the lower ring 30 could slide over the handles 60, but the upper ring 12 would be of a precise diameter so rest on the handles 60, as illustrated in detail in FIGS. 6 through 8. There is also illustrated a water line 65 which could be a typical garden hose extending from a faucet to provide a flow of water under pressure to the system 10. An end 66 of the hose 65 would be engaged to a connector 67, having a control handle 69 to control the flow of water into the system.

FIG. 1 also illustrates that the system 10 would be positioned on the pot 16, while the pot 16 is positioned on a typical burning assembly 70, of the type to support the pot 16 above the ground, so that a gas line 72 could provide propane gas from a tank 74 to heat the pot 16 and its contents. In this system 10, the burning assembly 70 would rest in a large collection pan 80, which would be used to collect the spray of water 52 flowing from the rings 12, 30 against the wall 15 of the pot 16, and when the pan 80 contains sufficient water, there is an opening 82 in the wall 84 of the pan 80 to allow the water to flow from the pan 80 into a drainage hose or line 84 to a remote location, such as a flower bed.

Finally, reference is now made to FIGS. 2 and 3 which illustrate the operation of the system 10 in conjunction with FIG. 1. In FIG. 2, the handle 69 is placed in the open position to allow water under pressure from a faucet to flow into system 10. The water would flow in the direction of first arrows 90, into the lower ring 30, and would flow through ring 30 (second arrows 92) wherein upon encountering the junctions 22, the water would flow upward through tube sections 40 (third arrows 94) and then into upper ring 12, where it would flow through the entirety of ring 12 (fourth arrows 96. During this water flow, as the water enters each ring 12, 30, the water would form the water spray 52 from plurality of orifices 50 in the wall of the rings 12, 30, against the wall of the pot 16 in a continuing flow until the cool water flow against the pot 16 would cool down its contents, such as boiled crawfish, crabs, shrimp or other boiled food. As seen in FIG. 2, the water, upon striking the wall of pot 16, would through gravity, flow down into the collection pan 80, out the opening 82 in the wall of the pan 80 (fifth arrows 98) and into the flow line 84 carrying the water away from the area of the pot 16.

Although the preferred embodiment discusses upper and lower rings around the pot 16, it is foreseen in other embodiments that there may only be a single ring or multiple rings (two or more) depending on the size of the pot and the amount of water to be distributed against the wall to undertake the cooling process. Additionally, although the pot 16 is shown and described as a pot with a single round wall, to meet the needs of the industry, it is foreseen in other embodiments that the pot 16 may be configured as square or other configurations. If so, the invention could still operate in the same manner as disclosed herein. In addition, the upper ring 12 may be supported in other manners other than resting on the handles 60 of the pot 16, for example on clips provided along the out wall of the pot, and the multiple rings 12, 30 may be of equal diameter.

PARTS LIST

10 system
12 upper ring
14 tubing
15 outer wall
16 boiling pot
17 lower wall portion
18 fluid flow bore
20 water (arrow 20)
30 lower ring
31 interior wall
40 tubing sections
22 junctions
25 nipples
42 upper end
43 lower end
50 orifices
52 water spray
60 handles
65 water line
66 end
67 connector
69 control handle
70 burning assembly
72 gas line
74 tank
80 collection pan
82 opening
84 wall
90 first arrows
92 second arrows
94 third arrows
96 fourth arrows
98 fifth arrows All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A system for cooling down a boiling vessel comprising:

a) a pot having a first length of tubing defining an upper ring encircling and supported by an outer wall of the pot, said first length of tubing having a continuous fluid flow bore through the first length of tubing, and a plurality of spaced apart openings along a first tubing wall;

b) a second length of tubing defining a lower ring encircling an outer wall of the pot, said second length of tubing having a continuous fluid flow bore through the second length of tubing and a plurality of spaced apart openings along a second tubing wall;

c) the lower ring having a lower ring diameter that is larger than an upper ring diameter;

d) a plurality of tubing connectors that connect the second length of tubing to the first length of tubing, each said tubing connector having a fluid flow bore that allows fluid in the second length of tubing to flow from the second length of tubing into the first length of tubing;

e) the said plurality of tubing connectors positioned around a circumference of the pot at spaced apart locations, and said plurality of tubing connectors extending at an angle between the second length of tubing and the first length of tubing;

f) a water line connector for engaging an end of a water line to the second length of tubing, said water line connector operable to receive water from a source under pressure and to flow the water under pressure into the second length of tubing;

g) the system operable to continuously flow water along a plurality of different flow paths, including wherein (1) water flowing along a first flow path flows from the source through the water line and water line connector to the second length of tubing and flows continuously around the second length of tubing until it exits out of an opening of the plurality of openings on the second length of tubing, and (2) water flowing along a second flow path flows from the source to the water line to the water line connector and into the second length of tubing, through one of said tubing connectors, to the first length of tubing and then around the first length of tubing until it exits through an opening of said plurality of openings on the first length of tubing; and h) wherein the system is operable to spray said water flowing out of the said openings of the first length of tubing and out the said openings of the second length of tubing against the outer wall of the pot to cool the pot.

2. The system in claim 1, wherein the plurality of tubing connectors define continuous channels for the water to flow from the lower ring to the upper ring.

3. The system in claim 1, wherein there is further provided a collection pan having an exit hose positioned below the pot to collect water flowing off of the wall of the pot, wherein the water can flow from the collection pan into the exit hose to a location away from the pot.

4. The system in claim 1, further comprising a pair of opposing handles on the outer wall of the pot and wherein the first length of tubing is supported by the pair of opposing handles, and wherein the lower ring diameter is longer than a distance between ends of the pair of opposing handles.

5. A system for cooling down a boiling vessel, the system comprising:

a) a pot having a first length of tubing defining an upper ring encircling an outer wall of the pot, the first length of tubing having a wall portion with a plurality of flow openings and a continuous fluid flow bore, the said plurality of flow openings defining a plurality of outlets for fluid to exit the continuous fluid flow bore, and the first length of tubing supported by opposing handles on the outer wall of the pot;

b) at least a second length of tubing defining a lower ring encircling the outer wall of the pot, and spaced a distance below the first length of tubing, the second length of tubing having a wall portion with a plurality of flow openings and a continuous fluid flow bore, the said plurality of flow openings defining a plurality of outlets for fluid to exit the continuous fluid flow bore;

c) a plurality of connecting tubes longitudinally positioned at spaced apart locations around a perimeter of the outer wall of the pot, said plurality of connecting tubes connecting the first length of tubing to the second length of tubing and extending between the fluid flow bore of the first length of tubing to the fluid flow bore of the second length of tubing;

d) a connector on the second length of tubing for engaging an end of a water line;

e) a source of water introduced into the water line to flow water under pressure along a flow path into the continuous fluid flow bore of the second length of tubing, through a said connecting tube and to the continuous flow bore in the first length of tubing; and f) wherein the system is operable to spray water flowing out of the said flow openings on the first and second lengths of tubing against the outer wall of the pot to cool the pot along its entire outer wall, while water is also flowing along the flow path.

6. The system in claim 5, wherein there is further provided a collection pan positioned below the pot to collect water flowing off of the wall of the pot, so that the water can flow from the pan into a hose to direct the water to a point away from the boiling pot.

7. The system in claim 5, further comprising two or more rings surrounding the pot wall, and wherein the two or more rings are connected together as a single system to deliver water against the outer wall of the pot to cool the contents of the pot.

8. A system for cooling down a boiling vessel comprising:

a) a pot having an upper tube encircling an outer wall of the pot, and having a fluid flow bore, said upper tube supported by opposing handles of the pot;

b) at least a lower tube encircling the outer wall of the pot a distance below the upper tube, said lower tube having a fluid flow bore;

c) a plurality of longitudinally positioned connecting tubes, each said connecting tube connecting the flow bore of the upper tube to the flow bore of the lower tube, and wherein the said connecting tubes are positioned at spaced apart locations around a perimeter of the outer wall of the pot;

d) a connector for engaging an end of a water line to the lower tube;

e) a source of water introduced into the lower tube through the water line and the connector, under pressure, the system operable to flow the water in a flow path through the lower tube, through the plurality of connecting tubes, and through the upper tube;

f) a plurality of flow openings spaced along the walls of the upper and lower tubes, wherein the system is operable to spray water from the said flow openings against the outer wall of the pot while water is flowing along the flow path; and g) a collection pan positioned below the pot to collect water flowing off of the outer wall of the pot, said collection pan including an outlet so that the water can flow from the pan into the outlet and to a location spaced away from the boiling pot.

9. The system in claim 8, wherein the upper tube is supported by the opposing handles of the pot as it is positioned around the wall of the pot.

10. A system for cooling down a boiling vessel, the system comprising:

a) a pot having an upper tube operable to be positioned around a perimeter of the pot, the upper tube forming an upper ring and having a continuous flow bore and a plurality of openings on a wall portion of the upper tube;

b) a lower tube operable to be positioned around a perimeter of the pot, the lower tube having a continuous flow bore and a plurality of openings on a wall portion of the lower tube, the lower tube spaced a distance below the upper tube;

c) a plurality of longitudinal connecting tubes connecting the lower tube and the upper tubes and each of said connecting tube having a flow bore that extends between the flow bore of the lower tube and the flow bore of the upper tube;

d) the lower tube forming a lower ring and having a lower ring diameter that is longer than an upper ring diameter, wherein the system is operable to be positioned around the pot with said lower tube sized so that the lower tube does not make contact with pot handles when being positioned on the pot, and wherein the upper tube is sized so that the upper tube rests on pot handles when positioned on the pot;

e) a water line connector on the lower tube, said water line connector operable to connect to a water line and receive water from a source under pressure and to flow the water under pressure into the lower tube;

f) the system operable to continuously flow water along a plurality of different flow paths, including wherein (1) water along a first flow path flows from the source, through the water line, to the lower tube and flows around the lower tube until it exits out of a said opening on the lower tube, and (2) water along a second flow path flows from the source, to the water line, into the lower tube, to one of said connector tubes, to the upper tube and around the upper tube until the water exits through a said opening on the upper tube, and (3) water along a third flow path flows from the source to the water line, into the lower tube, to another said connector tube, to the upper tube and around the upper tube until the water exits through a said opening on the upper tube; and g) the system operable to spray water that is exiting a said opening on the upper or lower tube against the outer wall of the pot while water is also flowing along the first, second and/or third flow paths.

* * * * *